US010604948B2

(12) United States Patent
Tisdall et al.

(10) Patent No.: US 10,604,948 B2
(45) Date of Patent: Mar. 31, 2020

(54) METHOD FOR INSTALLING TILES IN A WALL SYSTEM

(71) Applicant: DIRTT Environmental Solutions, Ltd., Calgary (CA)

(72) Inventors: Mark Tisdall, Calgary (CA); Brian Cassie, Calgary (CA); Kenton Hovdebo, Lomond (CA)

(73) Assignee: DIRTT Environmental Solutions, Ltd., Calgary (CA)

( * ) Notice: Subject to any disclaimer, the term of this patent is extended or adjusted under 35 U.S.C. 154(b) by 0 days.

(21) Appl. No.: 15/735,084

(22) PCT Filed: May 10, 2016

(86) PCT No.: PCT/US2016/031657
§ 371 (c)(1),
(2) Date: Dec. 8, 2017

(87) PCT Pub. No.: WO2017/196305
PCT Pub. Date: Nov. 16, 2017

(65) Prior Publication Data
US 2018/0179766 A1 Jun. 28, 2018

(51) Int. Cl.

| | |
|---|---|
| ***E04F 21/18*** | (2006.01) |
| ***E04F 13/08*** | (2006.01) |
| ***E04B 2/72*** | (2006.01) |
| *E04F 13/14* | (2006.01) |

(52) U.S. Cl.
CPC ..... *E04F 21/18* (2013.01); *E04B 2/72* (2013.01); *E04F 13/088* (2013.01); *E04F 13/14* (2013.01)

(58) Field of Classification Search
CPC ..... E04F 21/18; E04F 13/088; E04F 13/14; E04B 2/72
USPC ..... 52/204.71, 716.1, 717.03, 98–100, 244
See application file for complete search history.

(56) References Cited

U.S. PATENT DOCUMENTS

| | | | | |
|---|---|---|---|---|
| 2,140,196 | A * | 12/1938 | Batcheller | E04F 13/16 264/132 |
| 2,637,995 | A * | 5/1953 | Mann | E04F 13/0885 206/460 |
| 2,979,788 | A * | 4/1961 | Richardson | E06B 3/5409 52/204.597 |
| 3,309,832 | A | 3/1967 | Filsinger | |
| 3,953,268 | A | 4/1976 | Dillon | |

(Continued)

FOREIGN PATENT DOCUMENTS

| | | | |
|---|---|---|---|
| EP | 1206610 | | 3/2005 |
| JP | 09004194 | A * | 1/1997 |
| WO | 2017196305 | | 11/2017 |

OTHER PUBLICATIONS

International Search Report and Written Opinion for application No. PCT/US2016/031657 dated Feb. 15, 2017.

(Continued)

*Primary Examiner* — Brent W Herring
(74) *Attorney, Agent, or Firm* — Workman Nydegger

(57) ABSTRACT

A method for installing a tile to a wall includes applying a padded trim material to a front surface of the tile. With the trim material on the front surface of the tile, a force is applied to the trim material so that the tile is connected to the wall. Once the tile is connected to the wall, the trim material is removed from the tile.

16 Claims, 9 Drawing Sheets

(56) References Cited

U.S. PATENT DOCUMENTS 3,998,014 A * 12/1976 Bartels ..... E04B 9/0435 52/100
4,092,813 A * 6/1978 Eggert ..... B60J 10/16 296/207
4,443,508 A 4/1984 Mehl
4,763,454 A * 8/1988 Brockhaus ..... B60J 1/1815 160/354
4,775,570 A 10/1988 Ohlenforst
5,020,288 A * 6/1991 Swensen ..... E04G 21/30 156/99
5,079,880 A * 1/1992 Reid ..... A47K 3/008 52/288.1
5,107,643 A * 4/1992 Swensen ..... E04G 21/30 156/106
6,279,983 B1 * 8/2001 Biondo ..... B60J 10/70 296/93
6,513,861 B2 * 2/2003 DiGrazia ..... B60J 11/08 296/153
6,826,877 B1 * 12/2004 Stradel ..... E06B 1/34 49/462
7,188,885 B2 * 3/2007 Schlater ..... B60J 10/18 296/93
7,604,280 B2 * 10/2009 Katcherian ..... B60J 1/005 296/96.21
7,651,150 B2 * 1/2010 Schlater ..... B60J 10/18 296/96.21
8,050,022 B2 * 11/2011 McIntyre ..... G06F 1/1609 24/489
2003/0056449 A1 * 3/2003 Geiger ..... B60J 1/002 52/204.53
2004/0022997 A1 * 2/2004 Dujardin ..... B60R 13/043 428/99
2004/0055242 A1 * 3/2004 Iwakawa ..... B44C 5/04 52/578
2005/0211396 A1 * 9/2005 Doiron ..... E06B 9/02 160/222
2006/0022487 A1 * 2/2006 Schlater ..... B60J 10/18 296/146.15
2007/0182206 A1 * 8/2007 Schlater ..... B60J 10/18 296/146.15
2009/0288350 A1 * 11/2009 Fortman ..... B05B 12/24 52/105
2010/0102197 A1 * 4/2010 McIntyre ..... G06F 1/1609 248/687
2015/0147531 A1 * 5/2015 Anspach ..... E04F 15/0215 428/172
2016/0145934 A1 * 5/2016 Trott ..... E06B 5/11 52/203
2018/0309083 A1 * 10/2018 Hayashi ..... F21S 2/00

OTHER PUBLICATIONS

Non-Final Office Action for Singapore Patent Application No. 11201710364U dated Dec. 17, 2019.

* cited by examiner

METHOD FOR INSTALLING TILES IN A WALL SYSTEM

CROSS-REFERENCE TO RELATED APPLICATIONS

The present invention is a 35 U.S.C. § 371 U.S. National Stage of PCT Application No. PCT/US16/31657, filed on May 10, 2016, the entire content of which is incorporated herein by reference.

BACKGROUND

1. Technical Field

This disclosure relates generally to wall systems. More specifically, the present disclosure relates to apparatus, systems, methods, and devices for protecting glass or resin tiles, panels, windows, or other structures from damage while configuring and/or attaching the structures into walls.

2. Background and Relevant Art

Tile, panels, and other structures made of glass or other shatterable materials can provide an aesthetically pleasing look or provide useful functionality when applied as a surface or panel to a wall. However, there can also be a number of drawbacks to the use of such materials. For instance, glass, as well as ceramics, some resins, and other shatterable materials, are fragile and subject to breakage. Because of the properties of glass, building codes can be more stringent when glass is applied as a finish material.

In addition, connecting glass or other shatterable materials to a wall and/or integrating such tiles or panels into a wall can present further challenges. In such applications, which can require repeated connection, removal, and reconnection, the use of glass (and other shatterable materials) can be challenging, often resulting in damage to the tiles or panel, such as cracking, chipping, and shattering.

Accordingly, there is a need for installation methods and apparatus for wall systems having tiles, panels, or other structures made from glass or other shatterable materials that limit or avoid these disadvantages.

BRIEF SUMMARY

Implementations of the present disclosure solve one or more of the foregoing or other problems in the art with systems, methods, and apparatus for protecting tiles, windows, panels, passthroughs, or other such objects made from glass or other shatterable materials (e.g., ceramics, resins, etc.) while being attached or otherwise configured into and/or onto wall structures.

Certain implementations of this disclosure include a method of installing a tile or panel in a wall by first applying a trim material to one or more front surfaces and/or edges of the tile or panel. In some embodiments, the trim material is applied to a front surface of the tile or panel opposite to a connector disposed on a rear surface of the tile or panel. In some embodiments, the trim material is applied to the tile or panel where the front surface and a side surface of the tile or panel meet. The trim material may extend widthwise over the front edge of the tile or panel so that it extends partway over the front surface of the tile or panel and partway over one or more side surfaces of the tile or panel. The trim material may extend lengthwise along one or more front edges of the tile or panel.

In certain implementations, the trim material may be softer than the tile or panel material. Additionally, or alternatively, the trim material may be or include an easy release tape on the side of the trim material that adheres to the tile or panel when the trim material is applied to the tile or panel. This easy release tape remains on the trim material after the trim material has been removed from the tile or panel after the tile or panel has been installed.

In certain implementations, the tile or panel may be installed for use in a wall by exerting force on the trim material. Exerting a force on the trim material, rather than the tile or panel itself, protects the tile or panel from chipping, cracking, or shattering.

Additional features and advantages of exemplary implementations of the present disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Implementations of the present disclosure are directed to systems, methods, and apparatus for protecting tiles, windows, panels, passthroughs, or other such objects made from glass or other shatterable materials (e.g., ceramics, resins, etc.) while being attached or otherwise configured into and/or onto wall structures.

Figure 1:
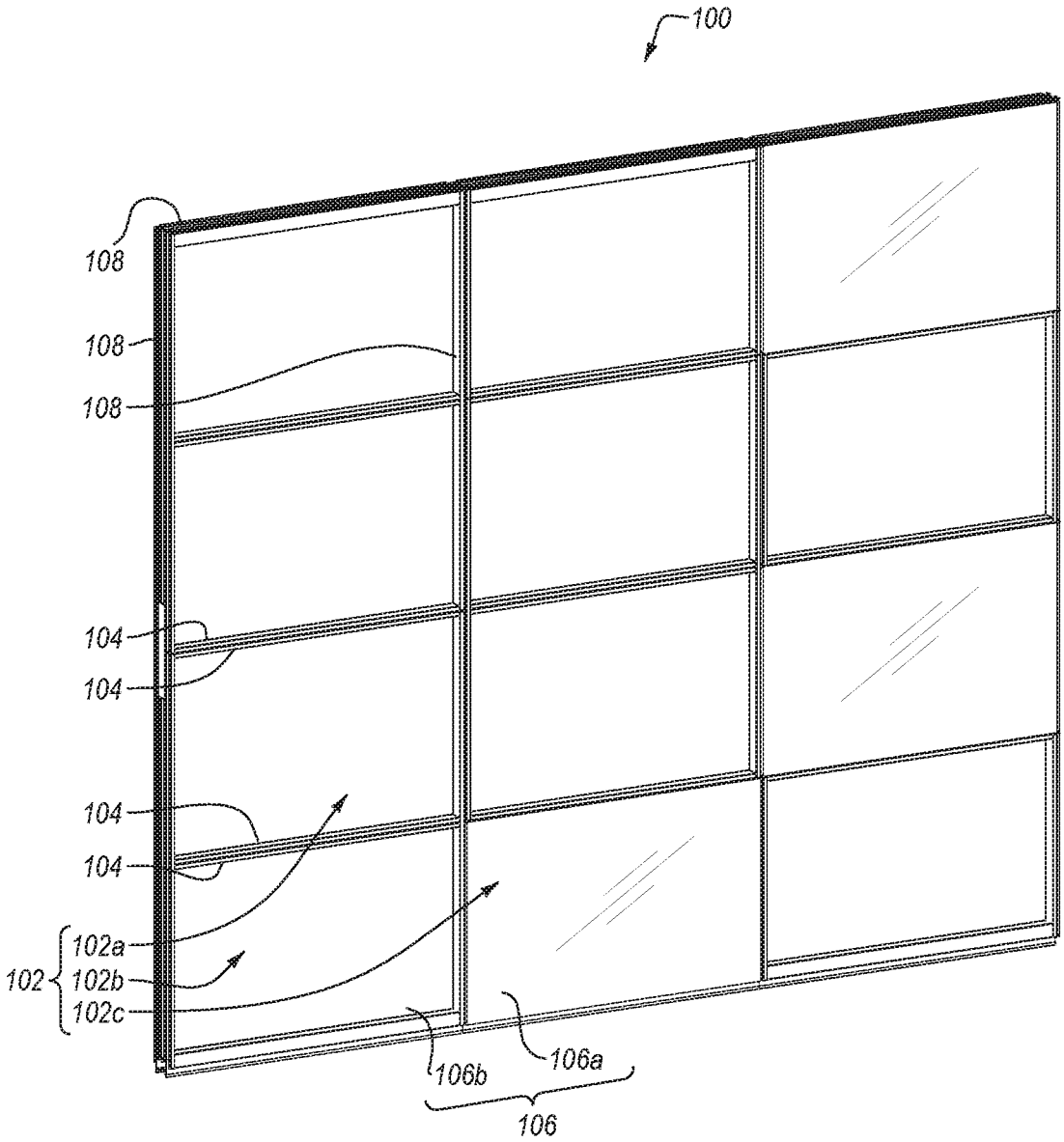
FIG. 1 illustrates a perspective view of a wall system formed at least partially using the methods of the present disclosure.

FIG. 1 illustrates a perspective view of an exemplary wall system formed according to one or more implementations of the present disclosure. More specifically, FIG. 1 illustrates a wall system 100 that includes a plurality of wall modules 102 (e.g., wall modules 102*a*, 102*b*, 102*c*) arranged and/or coordinated in relation one to another. As illustrated in FIG. 1, each module 102 can be connected and/or attached to another module 102 via one or more connection components 104, 108.

Modules 102 can also include and/or be clad with one or more tiles 106. Tiles 106 can comprise and/or be made of wood, plastic, metal, fabric, textile, fiber, fiberglass, plaster, drywall, glass, resin, and/or other suitable material. In addition, a plurality of different types of tiles can be arranged in a desired fashion to achieve a desired aesthetic or other purpose. For instance, wall system 100 can include a plurality of modules 102 having a combination of glass and wall tiles 106 arranged such that a consistent, random, alternating, and/or patterned (regular or irregular) configuration is displayed on a viewing surface or face thereof.

As illustrated in FIG. 1, for instance, the modules 102 of wall system 100 have been configured such that various arrangements of adjacent glass tiles 106*a* and wall tiles 106*b* can be observed. Glass tiles 106*a* and/or wall tiles 106*b* can be translucent, transparent, or opaque in various implementations. Accordingly, a variety of functional and aesthetic combinations can be available by arranging a plurality of modules 102 in various relationships.

As discussed in further detail below, in some implementations, a tile 106 can be mounted, secured, and/or attached to an outer edge or component of a module 102 and/or connection component(s) 104, 108 thereof. In some implementations, tiles 106 can be mounted, secured, and/or attached to both or opposing outer edges or components of a module 102 and/or connection component(s) 104, 108 thereof. For instance, tiles 106 can be mounted, secured, and/or attached to both or opposing outer terminal edges of opposing connection components 104. Similarly, tiles 106 can be mounted, secured, and/or attached to both or opposing outer sides of a single connection component 104.

Figure 2:
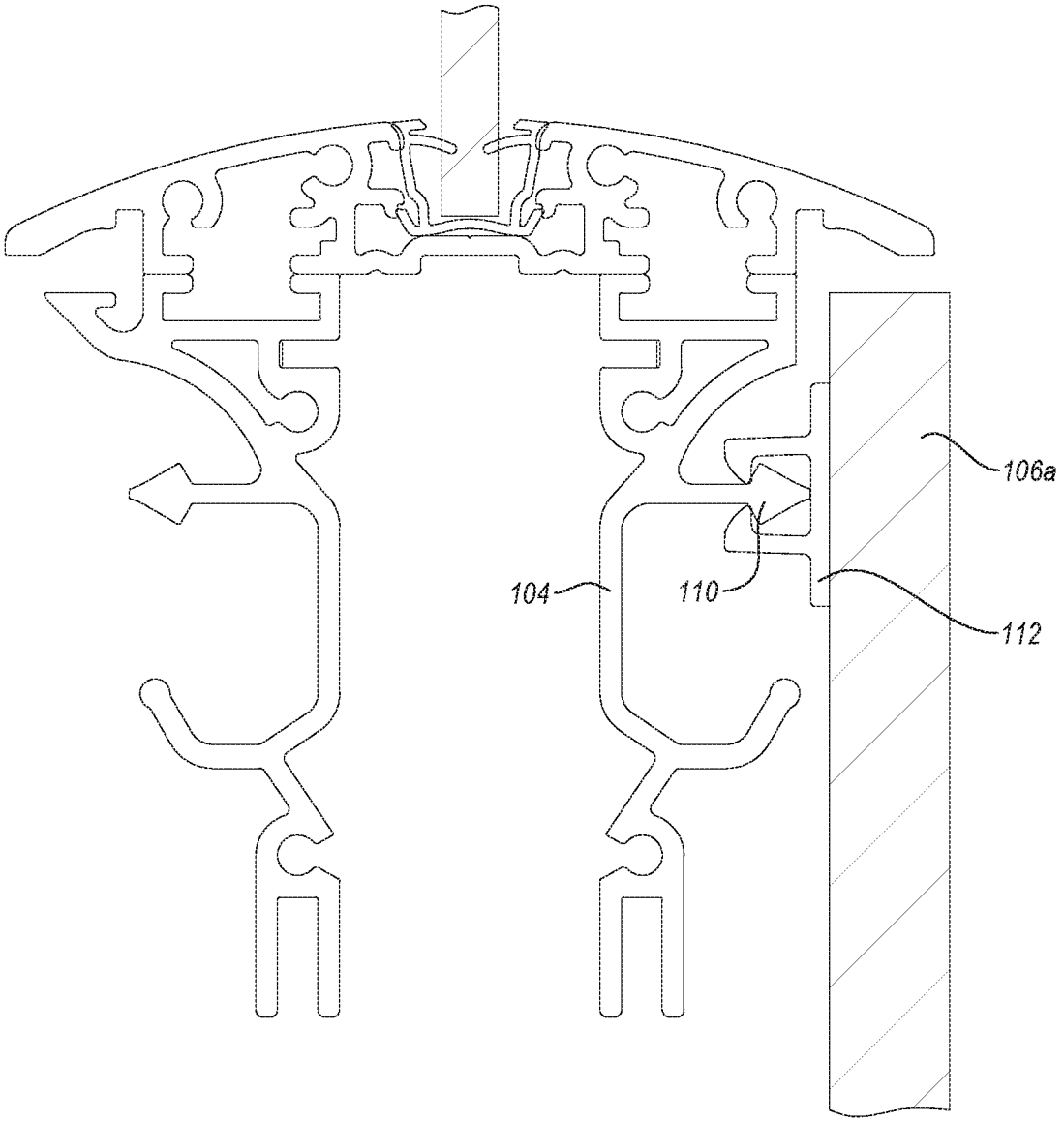
FIG. 2 illustrates a partial cross-sectional view of the wall system of FIG. 1.

In one or more implementations, wall system 100, or a module 102 or connection components 104 thereof configured to receive a glass tile 106*a* includes one or more tile attachment elements and the glass tile 106*a* includes one or more corresponding tile attachment elements. For instance, FIG. 2 illustrates a partial cross-sectional view of the wall system 100. As illustrated in FIG. 2, the connection component 104 includes a tile attachment element 110 and the glass tile 106*a* includes a tile attachment element 112. According to the illustrated embodiment, the tile attachment element 110 includes a barb or an arrow-shaped head and the tile attachment element 112 include one or more flexible arms with undercutting edges that clip or snap about the head of the tile attachment element 110 to secure them together. In particular, the flexible arms of the tile attachment element 112 can surround at least a portion of the head of the tile attachment element 110. It will be appreciated that the tile attachment elements 110, 112 can be reversed, such that element 110 is associated with the glass tile 106*a* and the element 112 is associated with the connection component 104. It will also be appreciated that other types of connection elements can be used to connect the glass tile 106*a* to the connection component 104.

As noted, implementations and embodiments of the present disclosure include panels or tiles formed from glass and/or other shatterable materials (e.g., ceramics, plasters, resins, etc.). To assist with installing (e.g., connecting, mounting) the fragile tiles to a wall structure or component thereof (e.g., connection components 104, 108), a trim material may be employed to prevent damage to the tile during installation. The trim material is preferrably softer and more flexible than the tile material. Trim materials may include foam, rubber, plastic, or any other material, or a combination of such materials. Additionally, or alternatively, a side of the trim material that makes contact with the tile may include a coat of easy release tape, epoxy, or other coating or material suitable for adherence of the trim material to the tile. The tape, epoxy, or other coating may remain on the trim material when the trim material is removed from the tile or panel.

Figure 3:
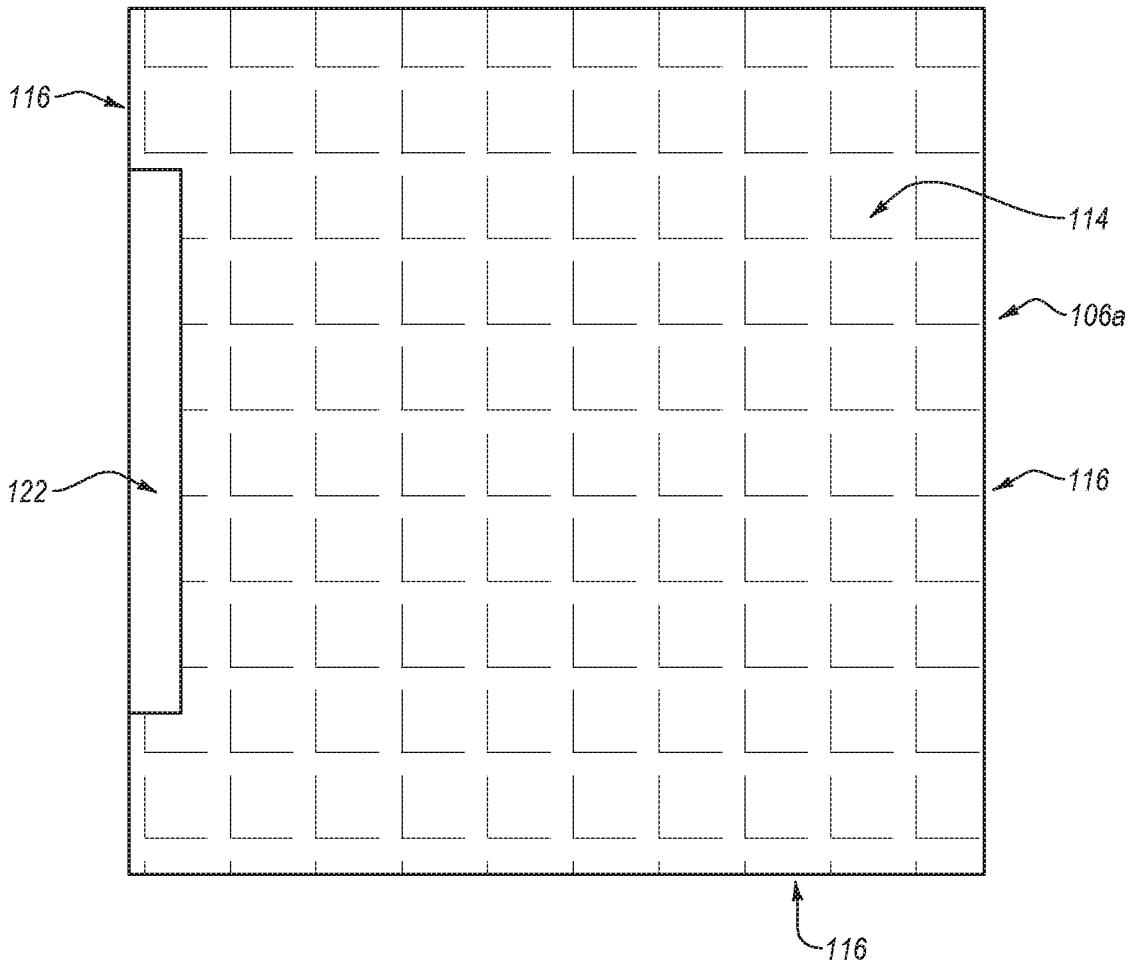
FIG. 3 illustrates a front view of a tile with a trim material applied on a front edge of the tile.
Figure 4:
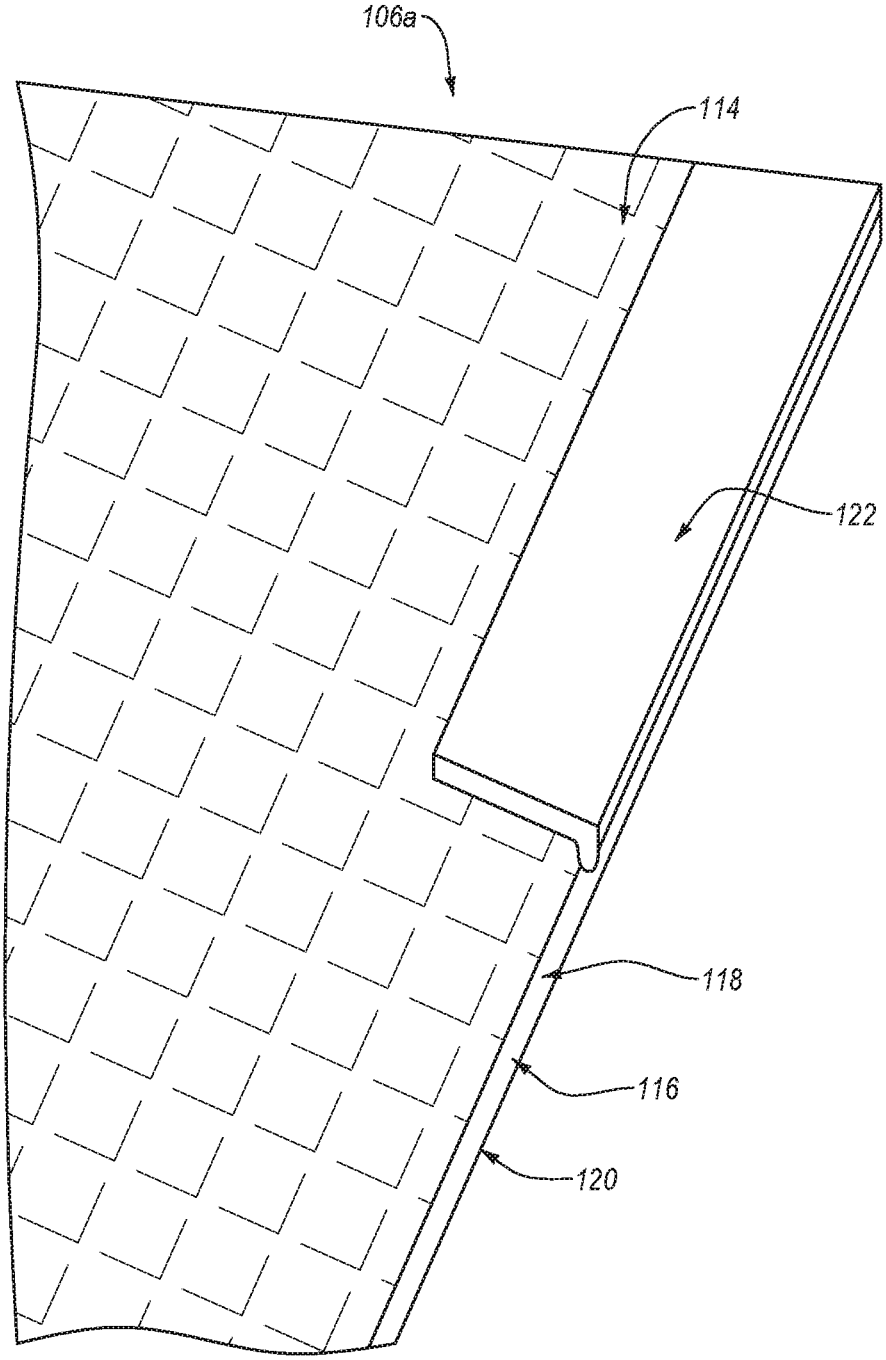
FIG. 4 illustrates a perspective view of the tile of FIG. 3 with the trim material applied on the front edge of the tile.

FIGS. 3 and 4 illustrate front and perspective views of an example tile 106*a* formed of glass, resin, or other shatterable material. As illustrated in the Figures, the tile 106*a* includes a front surface 114, side surfaces 116, front edge 118 (where front surface 114 and side surfaces 116 meet), and a rear surface 120. Prior to installation of the tile 106*a*, trim material 122 can be applied to the tile 106*a*. In some implementations, the trim material 122 is applied to the tile 106*a* upon completion of the manufacturing of the tile 106*a* (e.g., prior to shipping or transportation of the tile 106*a* to an installation site). In other implementations, the trim material is applied at the installation site prior to installation of the tile 106*a* to the wall system.

As illustrated in the Figures, at least a portion of the trim material 122 is applied to the front surface 114 of the tile 106*a*. For instance, the trim material 122 can be applied to the front surface 114 adjacent to one or more of the front edges 118. Additionally, in some implementations the trim material 122 is applied to the tile 106*a* so that a portion of the trim material 122 is applied to the front surface 114 and a portion is applied to one or more of the side surfaces 116 so as to cover or to extend widthwise over at least a portion of one or more of the front edges 118.

Although FIGS. 3 and 4 only show the trim material 122 applied to a portion of the front surface 114, side surface 116, and a front edge 118, it will be appreciated that this is merely exemplary. In other implementations, the trim material 122 may be applied to the front surface 114 adjacent to one or more of the front edges 118. Similarly, the trim material 122 may be applied to one or more of the front edges 118 and/or one or more of the side surfaces 116. The trim material 122 may either be pre-formed to fit the tile 106*a* or it may be cut and/or manipulated to apply to the tile 106*a* as desired. For instance, the trim material 122 may be applied to the front surface 114 and selectively folded over one or more of the front edges 118 and onto one or more of the side surfaces 116.

Figure 5:
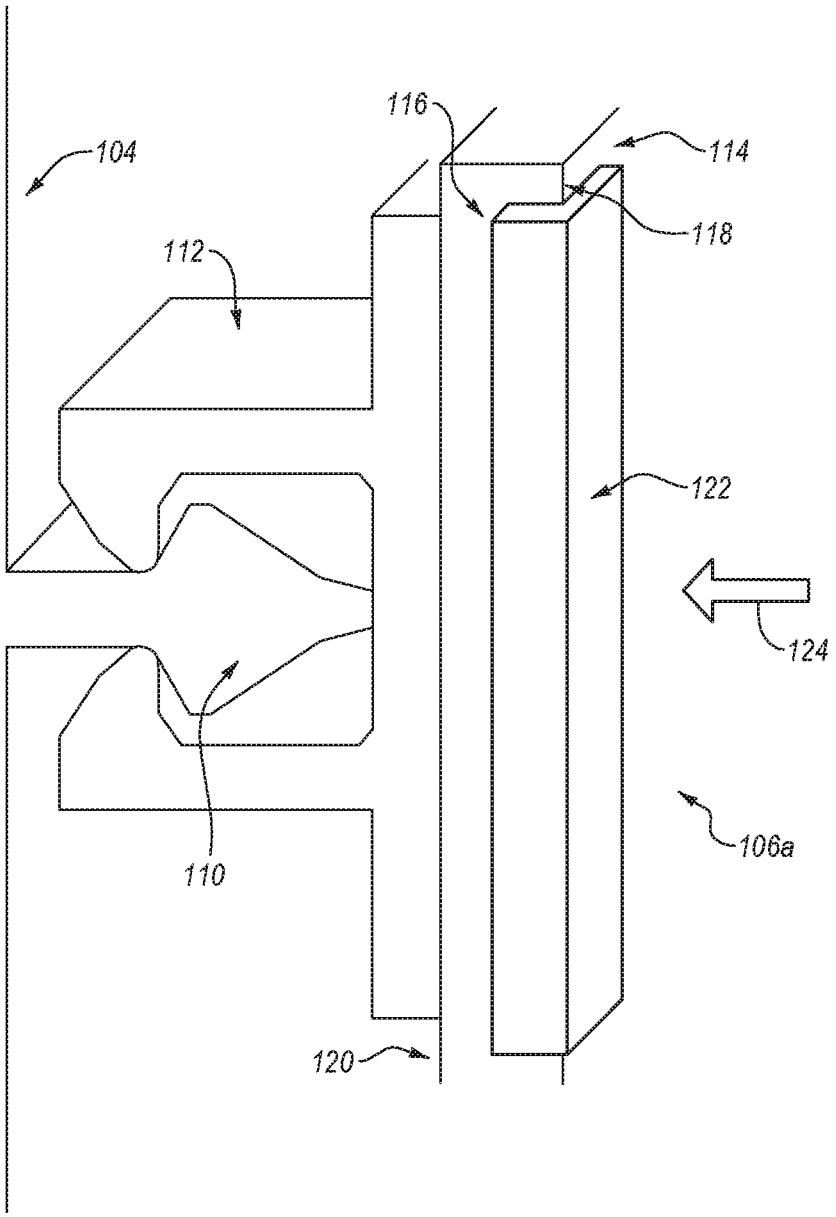
FIG. 5 illustrates a tile with a trim material applied and the tile installed in a wall.

FIG. 5 illustrates the tile 106*a* being attached to a connection component 104 of a wall system. As can be seen, the tile 106*a* has the trim material 122 applied to at least the front surface 114 thereof. To attach the tile 106*a* to the connection component 104 (and thus the wall system), a force (identified in FIG. 5 with reference number 124) is applied to the front surface 114 of the tile 106*a* in order to connect the tile attachment element 112 (on the rear surface 120 of the tile 106*a*) to the tile attachment element 110 on the connection component 104. To prevent the applied force from damaging the tile 106*a*, the force is applied to the trim material 122. As noted above, the trim material 122 may be softer and/or more flexible than the tile 106*a* material so that it provides cushioning to the tile 106*a* when the force is being exerted to secure the tile 106*a* to the wall system.

Although the trim material 122 is shown and described as being applied to the front surface 114 of the tile 106*a* near the front edge(s) 118, it will be understood that the trim material 122 may be applied to various areas on the front surface 114. For instance, the trim material 122 may be applied to the front surface 114 at a desired distance from the front edge(s) 118, at or near the center of the front surface 114, or at other locations on the front surface 114. For instance, in some embodiments, the trim material 122 is applied to the portion(s) of the front surface 122 that is/are opposite to the tile attachment element(s) 112.

Figure 6:
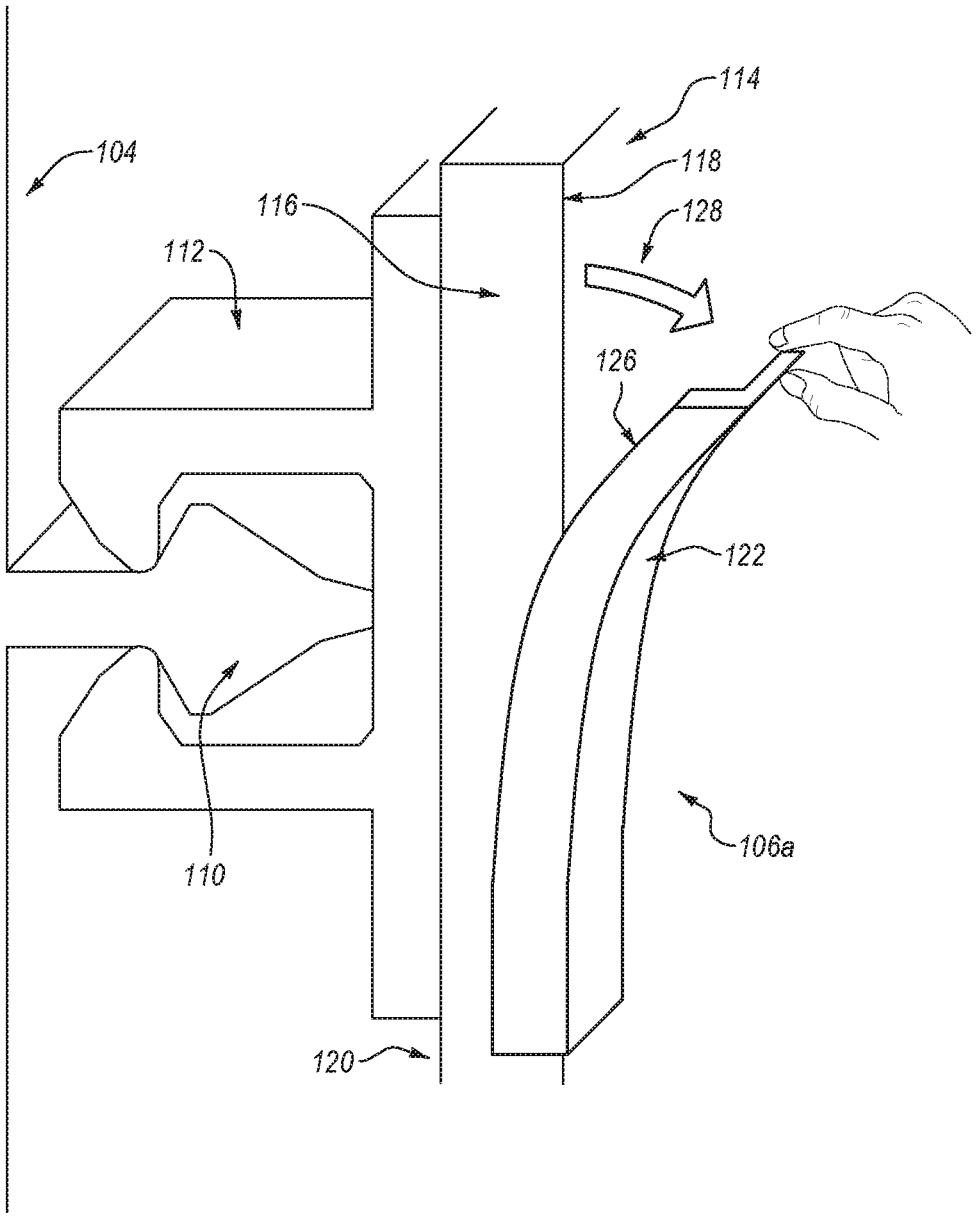
FIG. 6 illustrates the removal of the trim material from the tile.

Once the tile 106*a* is connected to the wall system, the trim material 122 may be removed from the tile 106*a*. FIG. 6 illustrates an example of the removal of the trim material 122 from the tile 106*a*. One side 126 of the trim material 122 (i.e., the side of the trim material 122 that makes contact with the tile 106*a*) is coated with or includes an easy release tape, epoxy, or other coating or material suitable to adhere the trim material 122 to the tile 106*a*. The trim material 122 can be removed from the tile 106*a* by peeling the trim material 122 off of the tile 106*a* as shown in FIG. 6. The arrow 128 in FIG. 6 indicates an example motion for removing the trim material 122 from the tile 106*a*. As the trim material 122 is removed from the tile 106*a*, the easy release tape, epoxy, or other coating or material remains on the trim material 122 such that it is removed with the trim material 122.

Figure 7:
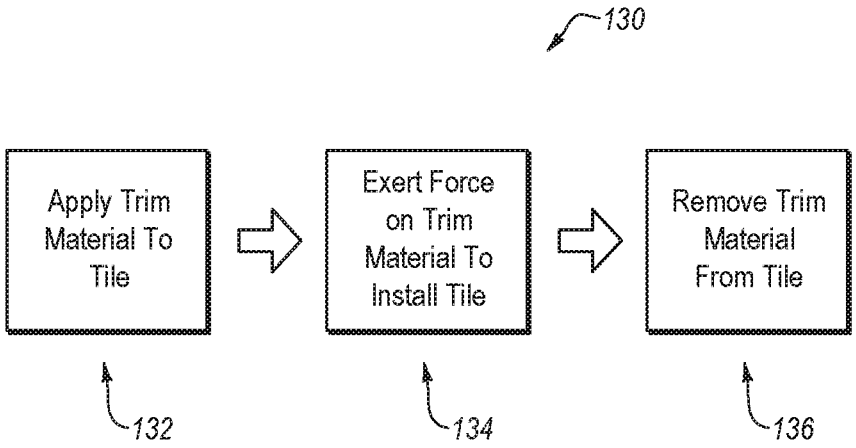
FIG. 7 is a flowchart of a method described in the present disclosure.

FIG. 7 is a flowchart of an example implementation of a method 130 according to the present disclosure. In describing the example method, reference will be made to the elements described elsewhere herein. It will be understood, however, that the method may be practiced with other elements.

According to method 130, a trim material is applied to a tile (132). For instance, as illustrated in FIG. 3-5, the trim material 122 may be applied to at least a portion of the front surface 114 of a tile 106*a*. In some embodiments, the trim material 122 is applied to the front surface 114 directly or nearly directly opposite to a tile attachment element 112 on the rear surface 120 of the tile 106*a*. In some embodiments, the trim material 122 is applied adjacent to or over one or more front edges 118 and onto one or more side surfaces 116 of the tile 106*a*. Applying the trim material 122 to the tile 106*a* can include adhering one surface 128 of the trim material 122 to the one or more surfaces of the tile 106*a*.

The method 130 also includes exerting a force on the trim material to install the tile in/to a wall system (134). For instance, as illustrated in FIG. 5, a force 124 can be applied to the trim material 122 in a direction that is generally normal to the front surface 114 of the tile 106*a* so that the tile 106*a* is pressed towards the wall system. As described herein, the trim material 122 can protect the tile 106*a* so that the applied force does not damage the tile 106*a*. The applied force can cause the tile attachment element(s) 112 on the rear surface 120 of the tile 106*a* to connect or engage the tile attachment element(s) 110 on the wall system (or connection component 104 thereof) in order to connect the tile 106*a* to the wall system.

The method 130 also include removing the trim material from the tile (136). More specifically, after the tile 106*a* is connected to the wall system, the trim material 122 (including the easy release tape, epoxy, or other coating or adhering material) is removed from the tile 106*a*. This can be done by peeling the trim material 122 away from the tile 106*a*.

Figure 8:
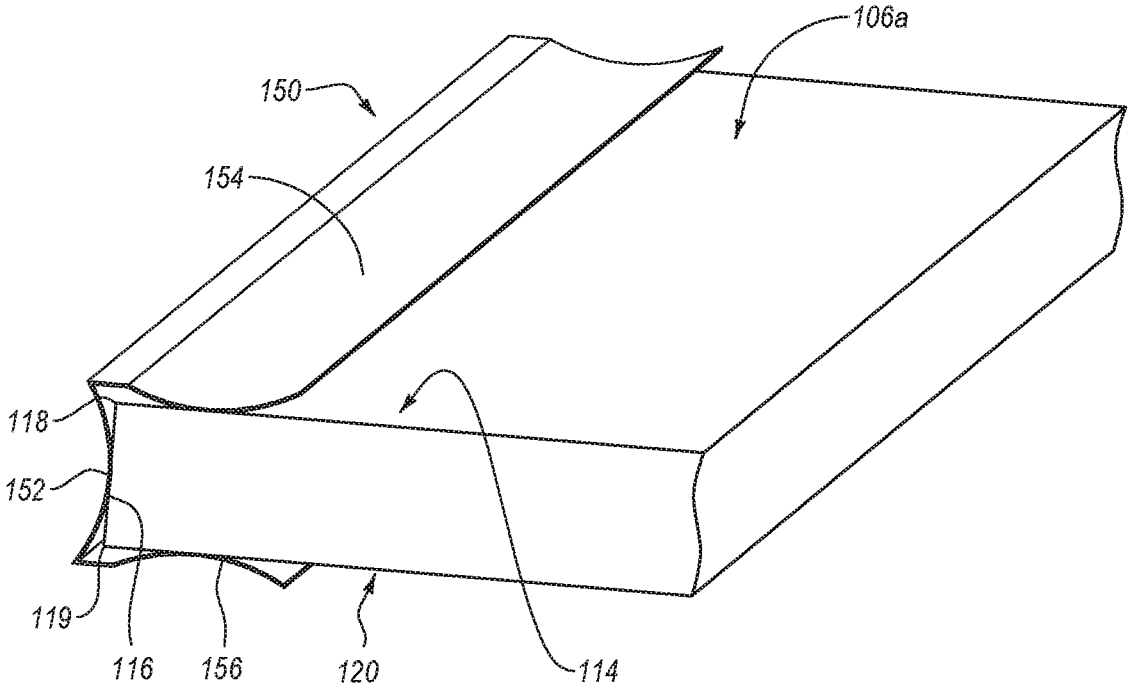
FIG. 8 illustrates a perspective view of a tile with a piece of trim applied to a side of a tile.
Figure 9:
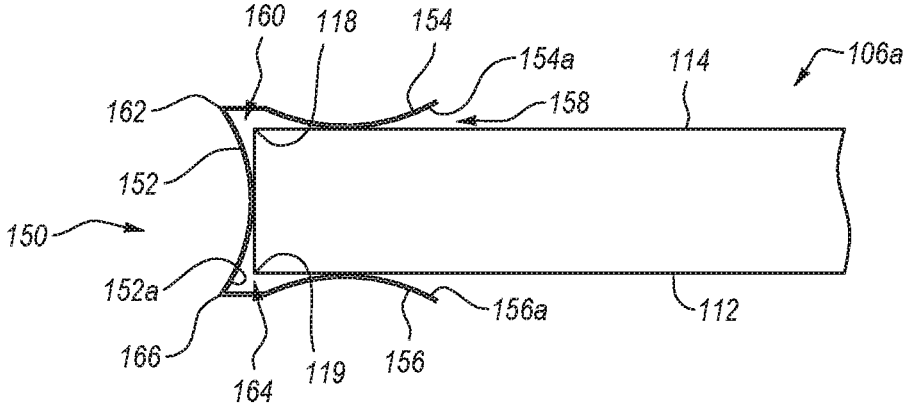
FIG. 9 illustrates an end view of the trim and tile of FIG. 8.

Attention is now directed to FIGS. 8-11, which illustrate another embodiment of a trim that can be used to protect a tile. More specifically, FIGS. 8 and 9 illustrate a perspective and an end view of a piece of trim 150 applied to a side of a tile 106*a*. According to the illustrated embodiment, the trim 150 covers the side surface 116, the front edge 118, a rear edge 119, and portions of the front and rear surfaces 114, 120 of the tile 106*a*. The trim 150 may be formed of a material (e.g., plastic, metal, etc.) that is sufficiently rigid and durable to protect the sides and edges of the tile 106*a*, such as during transportation of the tile 106*a*. As described in greater detail below, the trim 150 may also be shaped or otherwise configured to protect the sides and/or edges of the tile 106*a* while allowing for the trim 150 to be readily applied to or removed from the tile 106.

As can be seen in FIGS. 8 and 9, the trim 150 includes a spine 152 and legs 154, 156 extending therefrom. In the illustrated embodiment, the spine 152 is designed to be positioned adjacent to and extend along the side surface 116 of the tile 106*a*. The legs 154, 156 extend from opposing sides of the spine 152 so that the legs 154, 156 can extend over portions of the front and rear surfaces of the tile 106*a*, as illustrated in FIGS. 8 and 9. The legs 154, 156 are sufficiently spaced apart to allow the tile 106*a* to be inserted therebetween. However, the legs 154, 156 are also spaced close enough together to create a friction fit on the tile 106*a*.

According to the illustrated embodiment, the spine 152 and legs 154, 156 include curved interior surfaces 152*a*, 154*a*, 156*a*. The curved interior surfaces 152*a*, 154*a*, 156*a* can perform various functions and provide various benefits for the trim 150. For instance, the curved interior surfaces 154*a*, 156*a* on the legs 154, 156 create a flared opening 158, as best seen in FIG. 9. The flared opening 158 facilitates smooth insertion of the side of the tile 106*a* into the trim 106*a*. More specifically, the flared internal surfaces 154*a*, 156*a* act as guides to direct the side of the tile 106*a* into the trim 150. The guiding function of the curved interior surfaces 154*a*, 156*a* can also help protect the tile 106*a*, and particularly the front and rear edges 118, 119 thereof, as the tile 106*a* is being inserted into the trim 150. The curved interior surfaces 152*a*, 154*a*, 156*a* can also distribute any forces applied from the trim 150 to the tile 106*a*.

The curved interior surfaces 152*a*, 154*a*, 156*a* can also create gaps or buffer areas between portions of the trim 150 and portions of the tile 106*a* to protect the portions of the tile 106*a*. For instance, the curved interior surfaces 152*a*, 154*a* may create a gap or buffer area 160 on the interior of the corner 162 formed by the spine 152 and the leg 154. Similarly, the curved interior surfaces 152*a*, 156*a* may create a gap or buffer area 164 on the interior of the corner 166 formed by the spine 152 and the leg 156. As a result of the gaps 160, 164, the corners 162, 166 may be separated or spaced apart from the front and rear edges 118, 119 of the tile 106*a*. If external forces are applied to the trim 150, the gaps 160, 164 can provide a buffer to limit or prevent the force from being transferred to the front and rear edges 118, 119 of the tile 106, thereby protecting the tile 106*a* from external forces.

In addition, the curves surfaces 152*a*, 154*a*, 156*a* can facilitate flexing of the trim 150. The ability of the trim 150 to flex can also help prevent damage to the tile 106*a*. For instance, if an external force is applied to the trim 150, the curved surfaces 152*a*, 154*a*, 156*a* can allow the trim 150 to flex and move relative to the tile 106*a*. By way of example, if an external force is applied to the spine 152, the curved surface 152*a* may flex and absorb the energy of the force without damaging the front or rear edges 118, 119 of the tile 106*a* (due to the gaps 160, 164).

Figure 10:
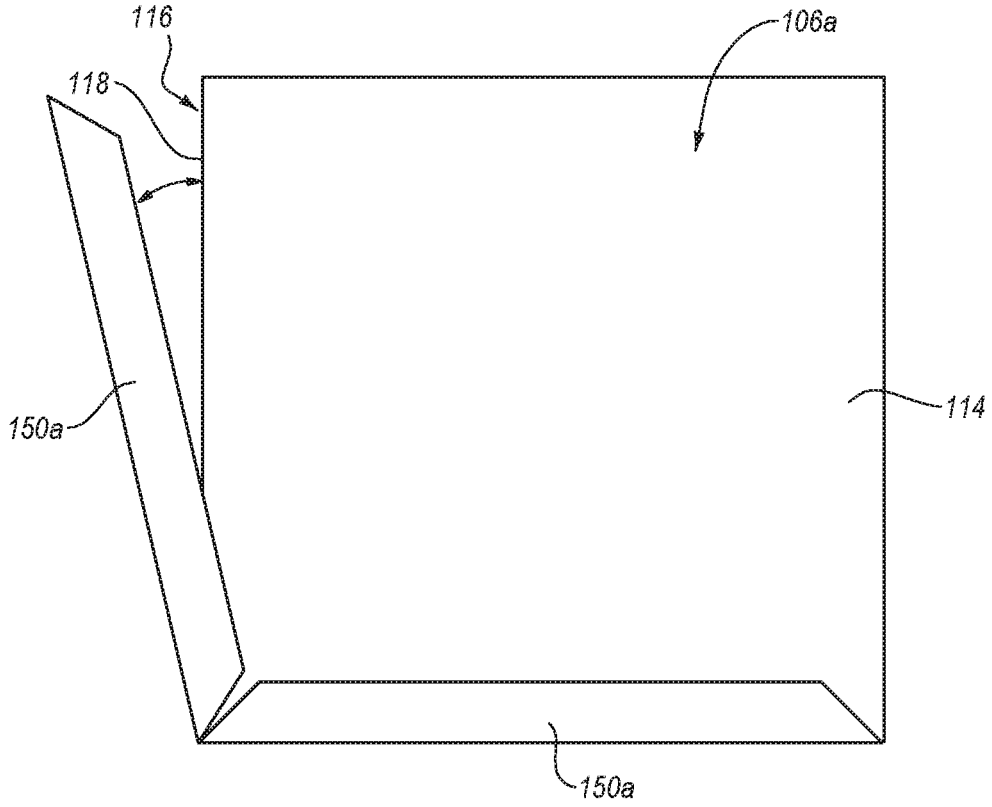
FIG. 10 illustrates a piece of trim material being applied to or removed from a tile.

FIG. 10 illustrates two pieces of trim 150*a* and a tile 106*a*. Except as described below, the pieces of trim 150*a* can be similar or identical to the trim 150 described above. Similarly, the process described below for applying or removing the trim 150*a* can be used to apply or remove trim 150.

In the illustrated embodiment, one of the pieces of trim 150*a* has been applied to one side of the tile, while the other piece of trim 150*a* is being applied to or removed from the tile 106*a*. To apply a piece of trim 150*a* to the tile 106*a*, a side (i.e., side surface 116, front and rear edges 118, 119) of the tile 106*a* are inserted into an opening (see flared opening 158 in FIG. 9) in the trim 150*a* between opposing legs (see legs 154, 156 in FIG. 9) of the trim 150*a*. As illustrated in FIG. 10, a portion of the side of the tile 106*a* can be inserted into the trim 150*a* and then the trim 150*a* can be angularly rotated to apply the rest of the trim 150*a* to the side of the tile 106*a*. Alternatively, the trim 150*a* can be applied laterally such that the trim 150*a* is applied to the entire length of the side of the tile 106*a* at the same time. In other embodiments, the tile 106*a* can be slid into an end of the trim 150*a*. Removing the trim 150*a* from the tile 106*a* can be accomplished by reversing the application process.

Unlike trim 122, which remains on the tile 106*a* during installation of the tile 106*a* on a wall, trims 150, 150*a* can be removed from the tile 106*a* prior to installation of the tile 106. Thus, for instance, after the tile 106*a* has been manufactured, a trim 150, 150*a* may be applied to one or more sides of the tile 106*a*. The trim 150, 150*a* may stay on the tile 106*a*, during storage, transportation, and the like of the tile 106*a*. Once the tile 106*a* is at the desired location for installation, the trim 150, 150*a* can be removed and the tile 106*a* can be installed on a wall.

In the illustrated embodiment, the pieces of trim 150*a* have mitered ends. In some embodiments, the mitered ends on adjacent pieces of trim 150*a* can have corresponding angles. For instance, in the illustrated embodiment, the pieces of trim 150*a* have ends that have been mitered to 45 degree angles. It will be appreciated, however, that the trim may have square ends rather than mitered ends. For instance, the trim 150 illustrated in FIG. 8 has a square end.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A method of installing a tile for use in a wall, the method comprising:

applying a trim material to the tile prior to installation of the tile on the wall, wherein applying the trim material comprises applying at least a portion of the trim material on at least a portion of a front surface of the tile and at least a portion of the trim material on at least a portion of one or more side surfaces of the tile, wherein the trim material extends over a front edge of the tile where the front surface and the side surface of the tile meet;

securing the tile to the wall, wherein securing the tile to the wall comprises exerting a force on the trim material; and removing the trim material from the tile after securing the tile to the wall, wherein all trim material is removed and the tile remains secured to the wall.

2. The method of claim 1, wherein applying the trim material comprises applying the trim material so that it extends lengthwise along the front edge of the tile.

3. The method of claim 1, wherein the trim material is softer than the tile material.

4. The method of claim 1, wherein the trim material comprises an easy release tape on a side thereof that makes contact with the tile, thereby enabling the trim material to be secured to the tile.

5. The method of claim 4, wherein the easy release tape remains on the trim material when the trim material is removed from the tile.

6. The method of claim 1, wherein applying the trim material comprises applying at least a portion of the trim material on at least a portion of a front surface of the tile directly opposite to a tile attachment element on a rear surface of the tile.

7. A method of installing a tile for use in a wall, the method comprising:

applying a padded trim material to at least a front surface and a side surface of the tile before installing the tile on the wall, wherein the padded trim material extends partway over the front surface of the tile, the side surface of the tile, and widthwise over a front edge of the tile where the front surface and side surface of the tile meet; and removing the padded trim material from the front surface, the side surface, and the front edge of the tile after installing the tile, wherein all padded trim material is removed and the tile remains installed on the wall.

8. The method of claim 7, wherein applying the padded trim material comprises applying a padded trim material that is softer than the tile material.

9. The method of claim 7, wherein the padded trim material comprises an easy release tape on a one side thereof, the easy release tape making contact with the tile when the padded material is applied to the tile, thereby enabling the padded material to be secured to the tile.

10. The method of claim 9, wherein removing of the padded material from the tile removes the easy release tape from the tile.

11. The method of claim 7, wherein applying the padded trim material to the front surface of the tile comprises applying the padded trim material opposite to a tile attachment member disposed on a rear surface of the tile.

12. The method of claim 7, further comprising securing the tile to the wall.

13. The method of claim 12, wherein securing the tile to the wall comprises exerting a force on the trim material in a direction generally normal to the front surface of the tile.

14. A method of installing a tile for use in wall, the method comprising:

providing a tile having a front surface, an opposing rear surface, and one or more tile attachment elements disposed on the rear surface, the one or more tile attachment elements being configured to interact with one or more wall attachment elements on the wall to secure the tile to the wall;

applying a padded trim material to at least the front surface of the tile so that the padded trim material is disposed directly opposite the one or more tile attachment elements, wherein applying the padded trim material is done prior to installation of the tile on the wall, wherein applying the padded trim material comprises applying at least a portion of the padded trim material on at least a portion of the front surface of the tile and at least a portion of the padded trim material on at least a portion of one or more side surfaces of the tile, wherein the padded trim material extends over a front edge of the tile where the front surface and the side surface of the tile meet;

securing the tile to the wall by exerting a force on the tile by pushing on the padded trim material to cause the one or more tile attachment elements to interact with the one or more wall attachment elements; and removing the padded trim material from the front surface of the tile after the tile is secured to the wall, wherein all padded trim material is removed and the tile remains secured to the wall.

15. The method of claim 14, wherein applying the padded trim material comprises applying the padded trim material to one or more front edge or side surfaces of the tile.

16. The method of claim 14, wherein removing the padded trim material comprises removing an easy release tape from the tile.

* * * * *